US005310370A

United States Patent [19]

Onoue

[11] Patent Number: 5,310,370

[45] Date of Patent: May 10, 1994

[54] THRUST SUPPORTING STRUCTURE FOR A MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 58,782

[22] Filed: May 7, 1993

Related U.S. Application Data

[63] Continuation of Ser. No. 702,636, May 17, 1991, abandoned.

[30] Foreign Application Priority Data

May 17, 1990 [JP] Japan ..... 2-125401

[51] Int. Cl.[5] ..... B63H 21/28

[52] U.S. Cl. ..... 440/75; 440/900

[58] Field of Search ..... 440/83, 78, 75, 900; 384/609, 615-622

[56] References Cited

U.S. PATENT DOCUMENTS 2,451,658 10/1948 Bugatti ..... 384/609
4,986,774 1/1991 Wantz ..... 440/75
4,986,775 1/1991 Wantz ..... 440/78

*Primary Examiner*—Edwin L. Swinehart
*Attorney, Agent, or Firm*—Knobbe, Martens Olson & Bear

[57] ABSTRACT

A thrust taking arrangement for a marine propulsion unit that employs a propeller shaft and a thrust transfer member that is affixed against an abutment on the propeller shaft and which transfers thrust to a lower unit housing through forward and reverse thrust bearings. In one embodiment, the thrust transfer member is permanently affixed to the propeller shaft and in the other embodiments, it is detachably connected by threaded connections.

30 Claims, 3 Drawing Sheets

THRUST SUPPORTING STRUCTURE FOR A MARINE PROPULSION UNIT

This is a continuation of U.S. patent application Ser. No. 702,636, filed May 17, 1991, entitled "THRUST SUPPORTING STRUCTURE FOR A MARINE PROPULSION UNIT", now abandoned.

BACKGROUND OF THE INVENTION

This invention relates to a thrust supporting structure for a marine propulsion unit and more particularly to an improved construction for transferring forward and reverse driving thrusts from a propeller shaft to the lower unit of a marine propulsion unit.

One well-known form of marine propulsion unit includes a forward/neutral/reverse transmission that is comprised of a driving bevel gear that is enmeshed with a pair of counter rotating driven bevel gears which are, in turn, journaled on a propeller shaft to which a propulsion device is affixed. A dog clutching arrangement selectively couples one of the driven bevel gears for rotation with the propeller shaft to drive an associated watercraft in a forward or reverse direction. A wide variety of thrust taking arrangements have been proposed for transferring driving thrusts from the propeller shaft to the lower, unit and, accordingly, to the associated watercraft.

One form of thrust taking arrangement provides a flange integrally on the propeller shaft which is engaged with forward and reverse thrust bearings for transferring forward and reverse driving thrusts from the flange to the lower unit housing. Although this construction has a number of advantages, there are certain disadvantages, particularly in the cost and difficulty of forming a flange integrally with the propeller shaft for transmitting the driving thrusts. If the propeller shaft is made from a machining operation, then there is substantial wastage of material as the shaft is machined to provide the resulting flange. On the other hand, if the propeller shaft is formed as a forging, then the material wastage is avoided, but the cost of manufacturing the forging is rather large because of the successive forging steps required. In addition, with each type of arrangement, it is difficult to insure that the thrust flange is formed at the appropriate location on the propeller shaft.

It is, therefore, a principal object of this invention to provide an improved thrust taking arrangement for the propeller shaft of a marine propulsion unit.

It is a further object of this invention to provide an improved thrust taking arrangement for the propeller shaft of a marine propulsion unit wherein forward and reverse drive thrusts are transmitted from the propeller shaft to the lower unit housing through a flange.

It is a further object of the invention to provide a thrust taking arrangement of the type described in the preceding paragraph wherein the flange need not be formed integrally with the propeller shaft.

SUMMARY OF THE INVENTION

The invention is adapted to be embodied in a thrust taking arrangement for the propeller shaft of a marine propulsion unit adapted to drive in forward and reverse directions. Means are provided for forming an abutment on the propeller shaft. A thrust transfer element separate from the propeller shaft is positioned on the propeller shaft in engagement with the abutment and means axially affix the thrust transfer element on the propeller shaft in engagement with the abutment.

DETAILED DESCRIPTION OF THE PREFERRED EMBODIMENTS OF THE INVENTION

Figure 1:
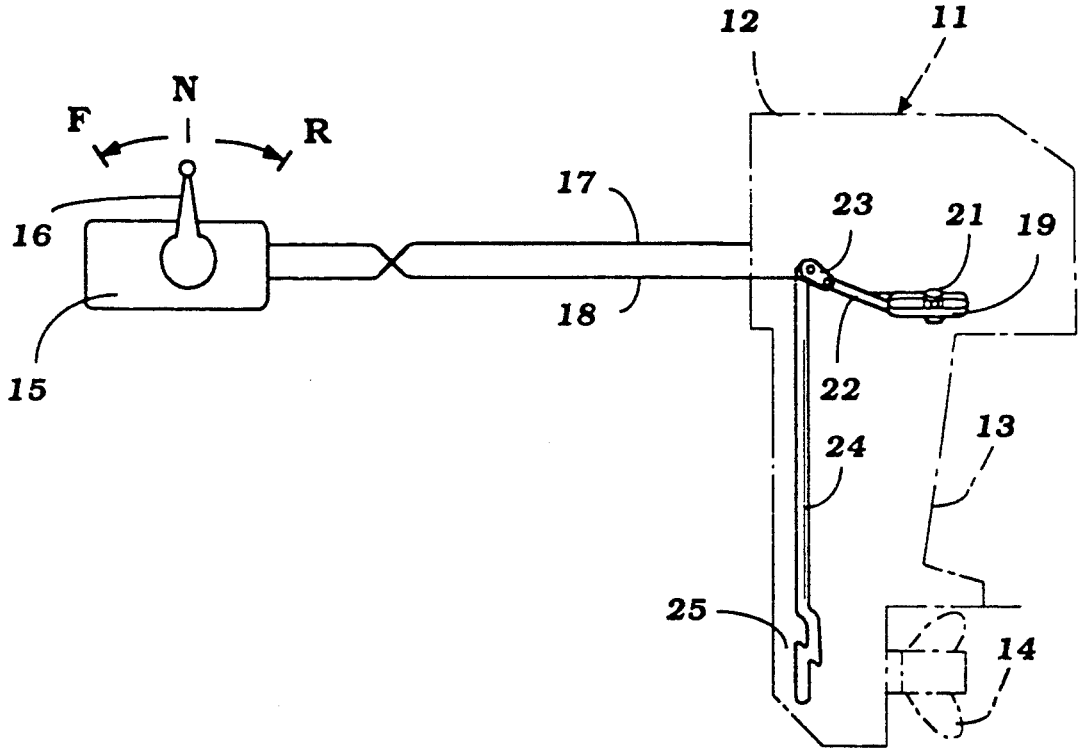
FIG. 1 is a partially schematic view of a marine propulsion unit and transmission control constructed in accordance with an embodiment of the invention, with the marine propulsion unit shown in phantom.

Referring first to FIG. 1, an outboard motor is indicated generally by the reference numeral 11 and is shown partially in phantom. The outboard motor 11 includes a power head 12 that is comprised of a powering internal combustion engine, which may be of any known type, and a surrounding protective cowling. The engine of the power head 12 drives a driveshaft (not shown in this figure) that is journaled in an appropriate manner within a driveshaft housing 13 and which drives a propeller 14 in selected forward and reverse directions through a forward/neutral/reverse transmission of a type which will be described by particular reference to the remaining figures.

This forward/neutral/reverse transmission is adapted to be controlled and shifted by a remote shift control mechanism 15 that includes a shift control lever 16, which is coupled by means of a pair of boden wire cables 17 and 18 to a shift cam 19. The shift cam 19 operates a follower 21 carried on a lever 22 for pivoting this lever. The lever 22 is connected by means of a crank 23 to a shift rod 24 that is journaled within the driveshaft housing and which has a lower crank portion 25. The crank portion 25 is connected to the transmission, in a manner as will now be described by reference to FIG. 2, for shifting the transmission.

Figure 2:
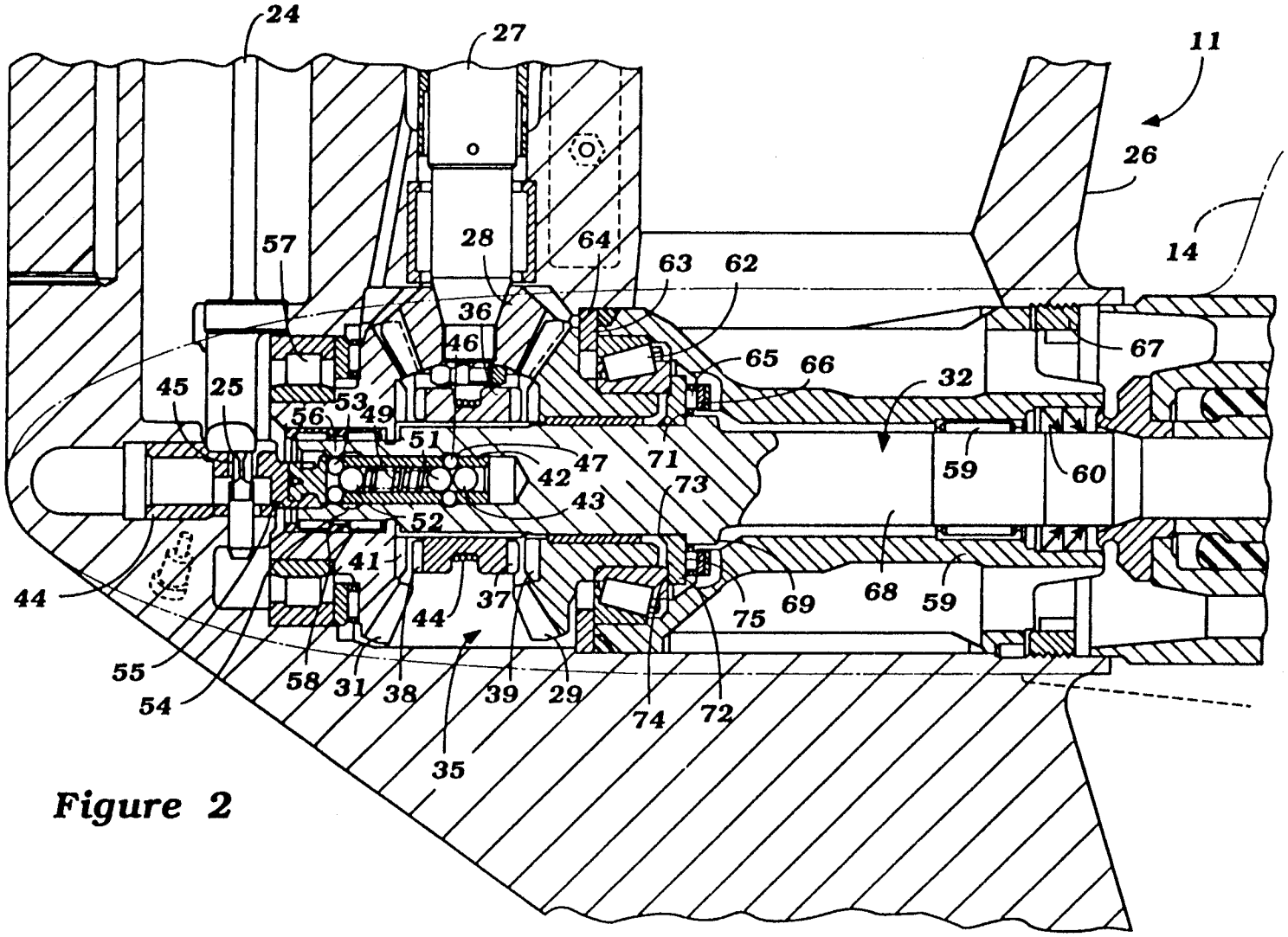
FIG. 2 is an enlarged cross-sectional view taken through the lower unit and shows the transmission and thrust taking arrangement.

Referring now in detail to FIG. 2, the forward/neutral/reverse transmission is contained within a lower unit housing, indicated generally by the reference numeral 26 and which is positioned at the lower end of the driveshaft housing 13. A driveshaft 27, as before referred to, extends into the lower unit housing 26 and has a driving bevel gear 28 affixed to it. The driving bevel gear 28 is in enmeshed with a forward driven bevel gear 29 and a reverse driven bevel gear 31, each of which is journaled on a propeller shaft 32.

Because of the diametrically opposed relationship of the driven bevel gears 29 and 31 to the driving bevel gear 28, the gears 29 and 31 will rotate in opposite directions. The driving and driven bevel gears 28 and 29 and 31 form portions of the forward/neutral transmission, indicated generally by the reference numeral 35. A dog clutching sleeve 36 has a splined connection to the portion of the propeller shaft 32 extending between the driven bevel gears 29 and 31. The dog clutching sleeve 36 has oppositely facing teeth 37 and 38 which are designed to be brought into meshing engagement with dog clutching teeth 39 and 41 formed on the gears 29 and 31, respectively, so as to rotatably couple the dog clutching sleeve 36 and propeller shaft 32 to one of these gears. When the dog clutching sleeve 36 is in the neutral position, as shown in FIG. 2, there is no driving relationship and the driveshaft 27 will rotate without causing rotation of the propeller shaft 32.

A shifting sleeve 42 is contained within a bore formed in the forward end of the propeller shaft 32 and is coupled to the dog clutching sleeve 36 by means of a pin 43. A torsional spring 44 encircles a groove in the outer periphery of the dog clutching sleeve 36 and holds the pin 43 in position.

The sleeve 42 has a connection to a shift cam 44 which is slidably supported within the lower unit housing 26 and which permits rotation of the sleeve 42 relative to the shift cam 44, but which couples the shift cam 44 and sleeve 42 for simultaneous axial movement. The shift cam 44 has a cam follower slot 45 that receives the crank portion 25 of the shift rod 24 so as to reciprocate the cam 44 and sleeve 42 upon rotation of the shift rod 24.

The dog clutching sleeve 36 and shift plunger 42 are releasably restrained in the neutral position, as shown in FIG. 2, by a plurality of detent balls 46 that are received within detent recesses 47 formed in the propeller shaft 32 and which are positioned in complementary openings in the shift sleeve 42. The detent balls 46 are held in this position under the action of a coil compression spring 49 which acts, at one end, against a ball 51 so as to cam the detent balls 46 outwardly.

The spring 49 is engaged, at its opposite end, with a further ball 52 that urges further detent balls 53 outwardly. The balls 53 cooperate with forward detent recesses 54 so as to hold the dog clutching sleeve 36 in engagement with the driven bevel gear 29 in the forward drive position and reverse detent recesses 55 for holding the dog clutching sleeve 36 in engagement with the reverse drive gear 31. A land portion 56 separates the forward and reverse detent recesses 54 and 55 and cams the balls 53 inwardly when the dog clutching sleeve 36 is in its neutral position.

It should be readily apparent that rotation of the shift rod 24 in one direction will cause the plunger 44 and shift sleeve 42 to move rearwardly and the dog clutching teeth 37 and 39 to become engaged with each other for providing forward drive. Rotation of the shift rod 24 in the opposite direction will cause the sleeve 36 to be drawn forwardly to bring the dog clutching teeth 38 and 41 into engagement to effect forward drive.

A non-thrust type of anti-friction bearing 57 is supported with its outer race in the lower unit housing 26 and its inner race in engagement with a hub formed on the reverse bevel gear 31. Anti-friction bearings 58 are positioned between the inner portion of this hub and the outer portion of the forward end of the driveshaft 32 so that the driven bevel gear 31 and driveshaft 32 will be rotatably journaled at their forward end within the lower unit housing 26.

A bearing carrier 59 is positioned within a bore formed in the lower rear portion of the lower unit housing 26 and carries a bearing 60 for rotatably journaling the rear end of the propeller shaft 32. Seals 61 protect the bearings 59 and the hub of the propeller 14 is affixed to the adjacent end of the propeller shaft 32 in a known manner.

The bearing carrier 59 further supports a forward thrust bearing 62 which has its outer race contained within the bearing carrier 59 and held in position by a washer 63 which may be affixed in an appropriate manner against a shoulder 64 formed in the lower unit housing 26 so as to transfer forward driving forces from the propeller shaft 32 to the lower unit 26 and propel the watercraft in a forward direction, in a manner as will be described. In addition, a reverse thrust bearing 65 is interposed, in a manner to be described, between the thrust transfer arrangement which will be described, and which bears against a washer 66 for transferring reverse thrust to the bearing carrier 59 and thence to the lower unit housing 26. The bearing carrier 59 is held to the lower unit housing 26 by a retaining nut 67 so that this reverse thrust force will be transmitted.

The construction of the lower unit and transmission as thus far described may be considered to be conventional. For this reason, further details of the portion of the construction thus far described are not believed to be necessary to enable those skilled in the art to practice the invention. However, in accordance with previous arrangement, a flange has been formed integrally on the propeller shaft 32 between the thrust bearings 62 and 65 so as to transfer the thrust from the propeller shaft 32 to the lower unit housing 26 in the manner previously described. The disadvantages of using such an integral thrust flange have already been described.

In accordance with the invention, the propeller shaft 32 is formed, forwardly of a rear portion 68 that is contained within the bearing carrier 59, with a protuberance or stop 69 which has a forwardly facing abutment surface 71. A thrust washer 72 is slid onto the propeller shaft 32 in engagement with the abutment 71 and then is locked in axial position in engagement with this shoulder 71 in an appropriate manner, as by welds 73. The thrust transfer member 72 has a forwardly facing thrust transfer surface 74 that is engaged with the inner race of the forward thrust bearing 62 and a rearwardly facing thrust face 75 which is in engagement with the reverse thrust bearing 65. As a result of this construction, it is possible to provide a separate member which will cooperate with the propeller shaft 32 for transferring the forward and reverse drive thrust to the lower unit housing 26 while permitting a very low cost and easily formed construction.

Figure 3:
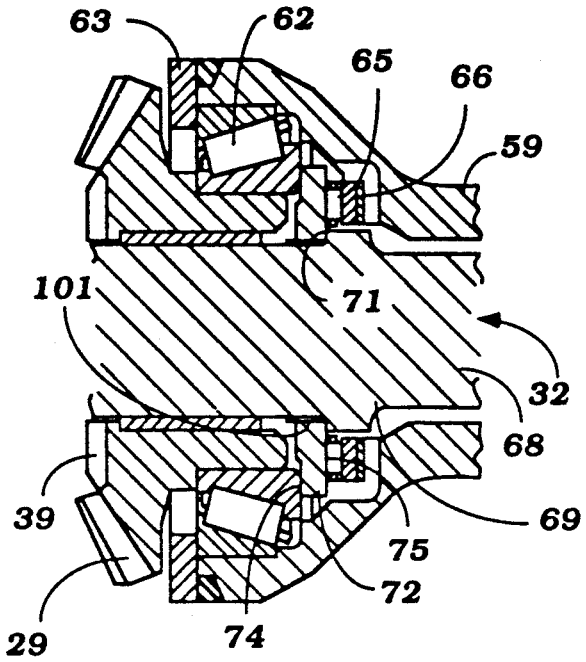
FIG. 3 is a partial cross-sectional view, in part similar to FIG. 2, and shows another embodiment of the invention.

Rather than affixing the thrust transfer member 72 to the propeller shaft 32 by welding, other arrangements are possible. For example, the embodiment of FIG. 3 shows an arrangement wherein the thrust transfer member 72 is internally threaded and is threaded onto an externally threaded portion 101 of the propeller shaft 32 adjacent the shoulder 71 for urging the thrust transfer member 72 into engagement with the shoulder 71 and axially locking it to the propeller shaft 32.

Figure 4:
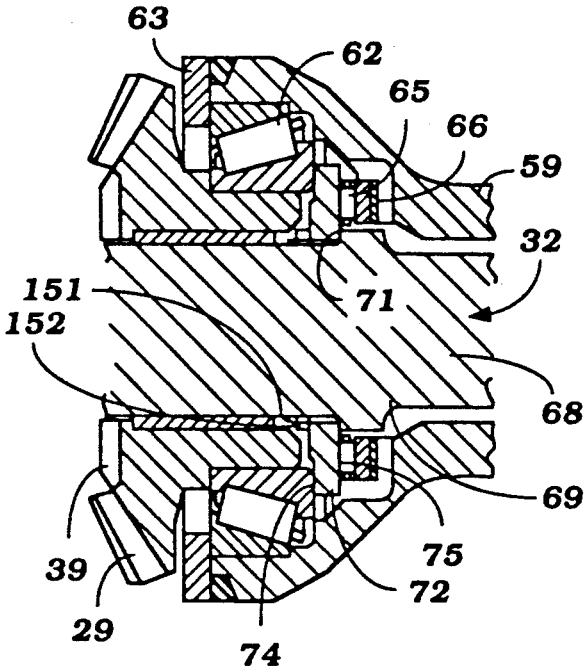
FIG. 4 is a partial cross-sectional view, in part similar to FIG. 3, and shows a further embodiment of the invention.

FIG. 4 shows another embodiment wherein the thrust transfer member 72 is not internally threaded, but wherein the propeller shaft 32 is provided with an external thread 151 forwardly of the shoulder 71 and which receives a locking nut 152 for urging the thrust transfer member 72 into engagement with the shoulder 71. A wide variety of other attaching mechanisms may be employed and various other changes and modifications may be made without departing from the spirit and scope of the invention, as defined by the appended claims.

I claim:

1. A thrust taking arrangement for a propeller shaft of a marine propulsion unit, a propulsion device coupled to said propeller shaft adapted to drive an associated watercraft in forward and reverse directions by exerting opposite axial thrusts to said propeller shaft, means forming an abutment on said propeller shaft facing in only the forward thrust direction, a thrust transfer member separate from said propeller shaft and positioned on said propeller shaft in engagement with said abutment, and means affixed directly to said propeller shaft for axially affixing said thrust transfer member to said propeller shaft in engagement with said abutment, the portion of the propeller shaft defining said abutment having a greater diameter than the remainder of said propeller shaft, said thrust transfer member having an annular configuration with an inner diameter sufficiently large to pass over the propeller shaft from at least one end thereof and to be engaged with said abutment and an outer diameter greater than the outer diameter of said abutment.

2. The thrust taking arrangement as set forth in claim 1 wherein the thrust transfer member has oppositely facing thrust transfer surfaces for transferring thrust to adjacent forward and reverse thrust bearings.

3. The thrust taking arrangement as set forth in claim 2 wherein the abutment is formed integrally with the propeller shaft.

4. The thrust taking arrangement as set forth in claim 3 wherein the thrust transfer member is permanently affixed to the propeller shaft by the means for axially affixing the thrust transfer member to said propeller shaft.

5. The thrust taking arrangement as set forth in claim 4 wherein the means for fixing the thrust transfer member permanently to the propeller shaft comprises a weld.

6. The thrust taking arrangement as set forth in claim 3 wherein the means for axially affixing the thrust transfer member to the propeller shaft detachably connects the thrust transfer member to the propeller shaft.

7. The thrust taking arrangement as set forth in claim 6 wherein the detachable connection is a threaded connection.

8. The thrust taking arrangement as set forth in claim 7 wherein the threaded connection is directly between the thrust transfer member and the propeller shaft.

9. The thrust taking arrangement as set forth in claim 7 wherein the threaded connection comprises a threaded member threaded onto the propeller shaft and engaging the thrust transfer member and urging the thrust transfer member into engagement with the abutment.

10. The thrust taking arrangement as set forth in claim 2 wherein the thrust transfer member is permanently affixed to the propeller shaft by the means for axially affixing the thrust transfer member to said propeller shaft.

11. The thrust taking arrangement as set forth in claim 10 wherein the means for fixing the thrust transfer member permanently to the propeller shaft comprises a weld.

12. The thrust taking arrangement as set forth in claim 2 wherein the means for axially affixing the thrust transfer member to the propeller shaft detachably connects the thrust transfer member to the propeller shaft.

13. The thrust taking arrangement as set forth in claim 12 wherein the detachable connection is a threaded connection.

14. The thrust taking arrangement as set forth in claim 13 wherein the threaded connection is directly between the thrust transfer member and the propeller shaft.

15. The thrust taking arrangement as set forth in claim 13 wherein the threaded connection comprises a threaded member threaded onto the propeller shaft and engaging the thrust transfer member and urging the thrust transfer member into engagement with the abutment.

16. The thrust taking arrangement as set forth in claim 1 wherein the marine propulsion unit comprises a lower unit housing rotatably journaling the propeller shaft and a driveshaft carrying a bevel gear engaged with a pair of counter rotating driven bevel gears journaled on the propeller shaft, the abutment being positioned rearwardly of the rearwardmost of the driven bevel gears.

17. The thrust taking arrangement as set forth in claim 16 wherein the thrust transfer member has oppositely facing thrust transfer surfaces for transferring thrust to adjacent forward and reverse thrust bearings.

18. The thrust taking arrangement as set forth in claim 17 wherein the abutment is formed integrally with the propeller shaft.

19. The thrust taking arrangement as set forth in claim 18 wherein the thrust transfer member is permanently affixed to the propeller shaft by the means for axially affixing the thrust transfer member to said propeller shaft.

20. The thrust taking arrangement as set forth in claim 19 wherein the means for fixing the thrust transfer member permanently to the propeller shaft comprises a weld.

21. The thrust taking arrangement as set forth in claim 18 wherein the means for axially affixing the thrust transfer member to the propeller shaft detachably connects the thrust transfer member to the propeller shaft.

22. The thrust taking arrangement as set forth in claim 21 wherein the detachable connection is a threaded connection.

23. The thrust taking arrangement as set forth in claim 22 wherein the threaded connection is directly between the thrust transfer member and the propeller shaft.

24. The thrust taking arrangement as set forth in claim 22 wherein the threaded connection comprises a threaded member threaded onto the propeller shaft and engaging the thrust transfer member and urging the thrust transfer member into engagement with the abutment.

25. The thrust taking arrangement as set forth in claim 17 wherein the thrust transfer member is permanently affixed to the propeller shaft by the means for axially affixing the thrust transfer member to said propeller shaft.

26. The thrust taking arrangement as set forth in claim 25 wherein the means for fixing the thrust transfer member permanently to the propeller shaft comprises a weld.

27. The thrust taking arrangement as set forth in claim 22 wherein the means for axially affixing the thrust transfer member to the propeller shaft detachably connects the thrust transfer member to the propeller shaft.

28. The thrust taking arrangement as set forth in claim 27 wherein the detachable connection is a threaded connection.

29. The thrust taking arrangement as set forth in claim 28 wherein the threaded connection is directly between the thrust transfer member and the propeller shaft.

30. The thrust taking arrangement as set forth in claim 28 wherein the threaded connection comprises a threaded member threaded onto the propeller shaft and engaging the thrust transfer member and urging the thrust transfer member into engagement with the abutment.

* * * * *